US010550721B2

(12) United States Patent
Hafner et al.

(10) Patent No.: US 10,550,721 B2
(45) Date of Patent: Feb. 4, 2020

(54) APPARATUS, TURBINE NOZZLE AND TURBINE SHROUD

(71) Applicant: GENERAL ELECTRIC COMPANY, Schenectady, NY (US)

(72) Inventors: Matthew Troy Hafner, Honea Path, SC (US); Gary Michael Itzel, Simpsonville, SC (US); John McConnell Delvaux, Fountain Inn, SC (US); Sandip Dutta, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 645 days.

(21) Appl. No.: 15/080,201

(22) Filed: Mar. 24, 2016

(65) Prior Publication Data

US 2017/0276021 A1 Sep. 28, 2017

(51) Int. Cl.
*F01D 25/12* (2006.01)
*F01D 5/18* (2006.01)
(Continued)

(52) U.S. Cl.
CPC ..... *F01D 25/12* (2013.01); *F01D 5/187* (2013.01); *F01D 9/041* (2013.01); *F01D 11/08* (2013.01);
(Continued)

(58) Field of Classification Search
USPC ..... 415/115, 97 R
See application file for complete search history.

(56) References Cited

U.S. PATENT DOCUMENTS 4,292,008 A * 9/1981 Grosjean ..... F01D 5/186 415/115
5,098,257 A * 3/1992 Hultgren ..... F01D 5/18 415/115
(Continued)

FOREIGN PATENT DOCUMENTS

EP 3075964 A1 10/2016
WO 2015/047698 A1 4/2015

OTHER PUBLICATIONS

Extended European Search Report and Opinion issued in connection with corresponding EP Application No. 17161520.6 dated Aug. 1, 2017.
(Continued)

*Primary Examiner* — Jessica Cahill
*Assistant Examiner* — Daphne M Barry
(74) *Attorney, Agent, or Firm* — McNees Wallace & Nurick LLC

(57) ABSTRACT

An apparatus is disclosed including a first and second article, a first interface volume disposed between and enclosed by the first article and second article, a cooling fluid supply, and at least one cooling fluid channel in fluid communication with the cooling fluid supply and the first interface volume. The first article includes a first material composition. The second article includes a second material composition. The at least one cooling fluid channel includes a heat exchange portion disposed in at least one of the first and second article downstream of the cooling fluid supply and upstream of the first interface volume. A turbine shroud is disclosed wherein the first and second articles are an outer and inner shroud. A turbine nozzle is disclosed wherein the first and second articles are an endwall and fairing.

19 Claims, 3 Drawing Sheets

(51) Int. Cl.
*F01D 9/04* (2006.01)
*F01D 11/08* (2006.01)

(52) U.S. Cl.
CPC .... *F05D 2220/32* (2013.01); *F05D 2260/213* (2013.01); *F05D 2260/2212* (2013.01)

(56) References Cited

U.S. PATENT DOCUMENTS 5,690,473 A 11/1997 Kercher
6,758,653 B2 * 7/2004 Morrison ..... F01D 9/04 415/116
7,217,088 B2 * 5/2007 Albrecht ..... F01D 5/18 415/115
7,448,850 B2 * 11/2008 Bulgrin ..... F01D 25/12 415/115
8,075,256 B2 * 12/2011 Little ..... F01D 11/001 415/173.1
8,162,598 B2 * 4/2012 Liang ..... F01D 11/005 415/115
2010/0068034 A1 * 3/2010 Schiavo ..... F01D 5/189 415/115
2010/0183435 A1 * 7/2010 Campbell ..... F01D 5/189 415/209.3
2012/0237786 A1 9/2012 Morrison et al.
2012/0257954 A1 10/2012 Chanteloup et al.
2013/0280040 A1 * 10/2013 Johns ..... F01D 5/188 415/115
2014/0064969 A1 * 3/2014 Romanov ..... F01D 11/08 416/174

OTHER PUBLICATIONS

Office Action issued in connection with corresponding EP Application No. 17161520.6 dated Oct. 26, 2018.

* cited by examiner

APPARATUS, TURBINE NOZZLE AND TURBINE SHROUD

STATEMENT REGARDING FEDERALLY SPONSORED RESEARCH OR DEVELOPMENT

The United States Government retains license rights in this invention and the right in limited circumstances to require the patent owner to license others on reasonable terms by the terms of Government Contract No. DE-FE0024006 awarded by the United States Department of Energy.

FIELD OF THE INVENTION

The present invention is directed to apparatuses, turbine nozzles, and turbine shrouds. More particularly, the present invention is directed to apparatuses, turbine nozzles, and turbine shrouds including cooling fluid channels.

BACKGROUND OF THE INVENTION

Gas turbines operate under extreme conditions. In order to drive efficiency higher, there have been continual developments to allow operation of gas turbines at ever higher temperatures. As the temperature of the hot gas path increases, the temperature of adjacent regions of the gas turbine necessarily increase in temperature, due to thermal conduction from the hot gas path.

In order to allow higher temperature operation, some gas turbine components, such as nozzles and shrouds, have been divided such that the higher temperature regions (such as the fairings of the nozzles and the inner shrouds of the shrouds) may be formed from materials, such as ceramic matrix composites, which are especially suited to operation at extreme temperatures, whereas the lower temperature regions (such as the outside and inside walls of the nozzles and the outer shrouds of the shrouds) are made from other materials which are less suited for operation at the higher temperatures, but which may be more economical to produce and service.

Joining the portions of gas turbines in higher temperature regions to the portions of gas turbines in lower temperature regions may present challenges, particularly with regard to interfaces between metals and ceramic matrix composite materials. Large thermal gradients between the metal portion and the ceramic matrix composite portion may result in high thermal strain in the component, reducing performance and component service life. Further, in many instances, components having a metal portion and a ceramic matrix composite portion include a volume between metal and ceramic matrix composite portions for which a flow of a purge gas is appropriate. Purge gas may be used, among other purposes, to minimize leaks between adjacent turbine components. However, providing both a purge fluid to purge the volume between the metal and the ceramic matrix composite portions as well as a temperature modulation fluid to reduce temperature differentials and thermal strain across the interface between the metal portion and the ceramic matrix composite portion may reduce the efficiency of the turbine by requiring a greater flow of fluid to be diverted from the compressor than either a purge fluid or a temperature modulation fluid would alone.

BRIEF DESCRIPTION OF THE INVENTION

In an exemplary embodiment, an apparatus includes a first article, a second article, a first interface volume disposed between and enclosed by the first article and the second article, a cooling fluid supply, and at least one cooling fluid channel in fluid communication with the cooling fluid supply and the first interface volume. The first article includes a first material composition. The second article includes a second material composition. The at least one cooling fluid channel includes a heat exchange portion disposed in at least one of the first article and the second article downstream of the cooling fluid supply and upstream of the first interface volume.

In another exemplary embodiment, a turbine nozzle includes an outside wall, a fairing, a first interface volume disposed between and enclosed by the outside wall and the fairing, an inside wall, a second interface volume disposed between and enclosed by the inside wall and the fairing, a cooling fluid supply, and at least one cooling fluid channel in fluid communication with the cooling fluid supply, the first interface volume, and the second interface volume. The outside wall includes a metal. The fairing includes a ceramic matrix composite. The inside wall includes a metal. The at least one cooling fluid channel includes a heat exchange portion disposed downstream of the cooling fluid supply and upstream of the first interface volume and the second interface volume.

In another exemplary embodiment, a turbine shroud includes an outer shroud, an inner shroud, a first interface volume disposed between and enclosed by the outer shroud and the inner shroud, a cooling fluid supply, and at least one cooling fluid channel in fluid communication with the cooling fluid supply and the first interface volume. The outer shroud includes a metal. The inner shroud includes a ceramic matrix composite. The at least one cooling fluid channel includes a heat exchange portion disposed downstream of the cooling fluid supply and upstream of the first interface volume.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DESCRIPTION OF THE INVENTION

Provided are exemplary apparatuses and gas turbine components, such as turbine nozzles and turbine shrouds. Embodiments of the present disclosure, in comparison to articles and methods not utilizing one or more features disclosed herein, decrease costs, decrease thermal strain, increase efficiency, improve elevated temperature performance, or a combination thereof.

Figure 1:
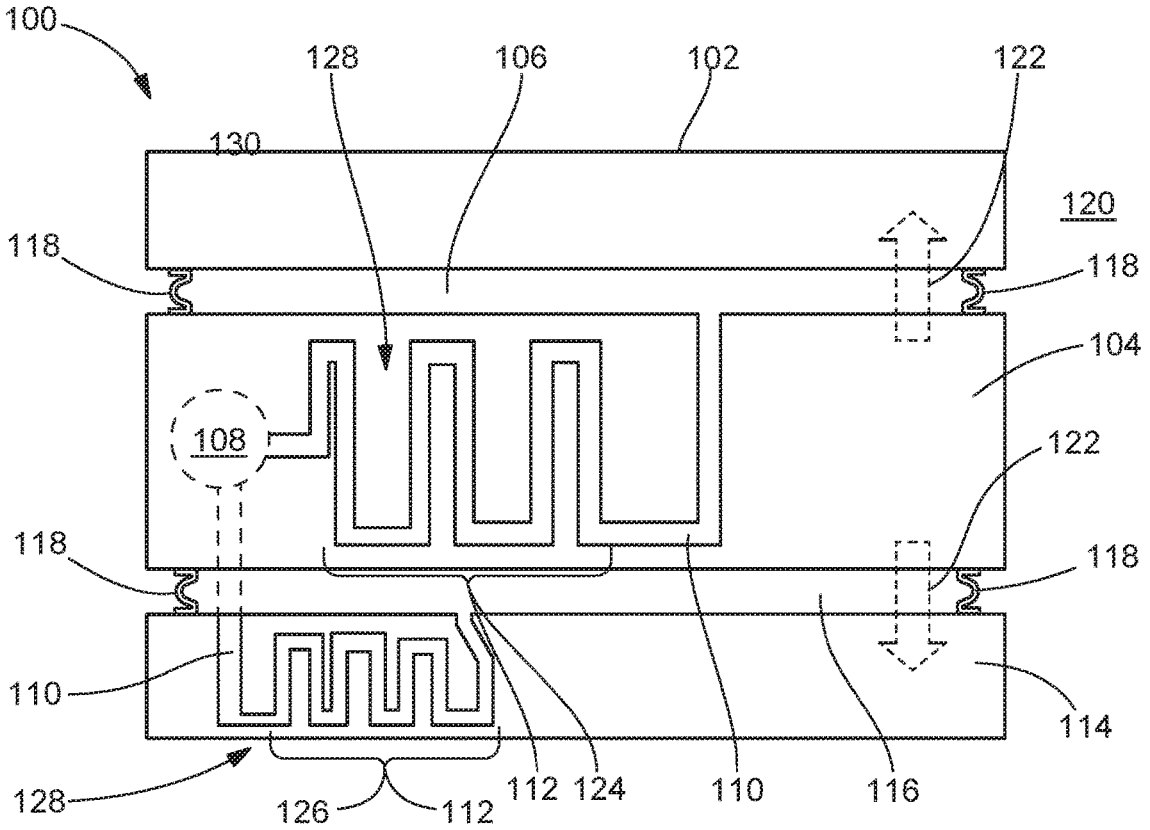
FIG. 1 is a schematic sectioned view of an apparatus, according to an embodiment of the present disclosure.

Referring to FIG. 1, in one embodiment an apparatus 100 includes a first article 102, a second article 104, a first interface volume 106 disposed between and enclosed by the first article 102 and the second article 104, a cooling fluid supply 108, and at least one cooling fluid channel 110 in fluid communication with the cooling fluid supply 108 and the first interface volume 106. The first article 102 includes a first material composition. The second article 104 includes a second material composition. The at least one cooling fluid channel 110 includes a heat exchange portion 112 disposed in at least one of the first article 102 (not shown) and the second article 104 (shown) downstream of the cooling fluid supply 108 and upstream of the first interface volume 106. In a further embodiment, the first material composition of the first article 102 includes a first thermal tolerance, and the second material composition of the second article 104 includes a second thermal tolerance greater than the first thermal tolerance.

In another embodiment, the apparatus 100 further includes a third article 114 and a second interface volume 116 disposed between and enclosed by the third article 114 and the second article 104. The third article 114 includes a third material composition. The at least one cooling fluid channel 110 is upstream of and in fluid communication with the second interface volume 116, and the heat exchange portion 112 is upstream of the second interface volume 116. In a further embodiment, the third material composition of the third article 114 includes a third thermal tolerance less than the second thermal tolerance.

The apparatus 100 may further include a sealing member 118 disposed between the first article 102 and the second article 104, wherein the sealing member 118 encloses the first interface volume 106, a sealing member 118 disposed between the second article 104 and the third article 114, wherein the sealing member 118 encloses the second interface volume 116, or both. The sealing member 118 may form a hermetic seal or a non-hermetic seal.

The first interface volume 106, the second interface volume 116, or both may be arranged and disposed to exhaust a cooling fluid from the cooling fluid supply 108 to an external environment 120. In one embodiment, wherein the sealing member 118 forms a non-hermetic seal, a partially restricted flow of the cooling fluid may pass by the sealing member 118 to exhaust to the outside environment. In another embodiment (not shown), the apparatus 100 may include a valve or restricted flow path independent of the sealing member 118 through which a partially restricted flow of the cooling fluid may pass to exhaust to the outside environment.

Utilizing the cooling fluid to purge the first interface volume 106, the second interface volume 116, or both, whether through a non-hermetic seal enclosed by sealing member 118, a valve, or a restricted flow path independent of the sealing member 118, may reduce the amount of a cooling fluid diverted from a cooling fluid supply 108, increasing efficiency of the apparatus 100 relative to a comparable apparatus using separate flows of the cooling fluid to thermally regulate the apparatus 100 and to purge the first interface volume 106, the second interface volume 116, or both.

The first material composition may be any suitable material, including, but not limited to, a metal, a nickel-based alloy, a superalloy, a nickel-based superalloy, an iron-based alloy, a steel alloy, a stainless steel alloy, a cobalt-based alloy, a titanium alloy, or a combination thereof. The second material composition may be any suitable material, including, but not limited to, a refractory metal, a superalloy, a nickel-based superalloy, a cobalt-based superalloy, a ceramic matrix composite, or a combination thereof. The ceramic matrix composite may include, but is not limited to, a ceramic material, an aluminum oxide-fiber-reinforced aluminum oxide (Ox/Ox), carbon-fiber-reinforced carbon (C/C), carbon-fiber-reinforced silicon carbide (C/SiC), and silicon-carbide-fiber-reinforced silicon carbide (SiC/SiC). In one embodiment, the first material composition is a metal and the second material composition is a ceramic matrix composite.

In an embodiment having a first article 102 and a third article 114, the third material composition may be the first material composition, or the third material composition may include a distinct material composition from the first material composition. As used herein, a "distinct" material composition indicates that the first material composition and the third material composition differ from one another by more than a difference in trace impurities such that the first material composition and the third material composition have material properties which are sufficiently different from one another to have a material affect at the operating conditions to which the article 100 is subjected. Also in an embodiment having a first article 102 and a third article 114, the third thermal tolerance may be the first thermal tolerance, or the third thermal tolerance may be distinct from the first thermal tolerance.

In one embodiment, the apparatus 100 includes a reduced thermal gradient 122 between the first article 102 and the second article 104 relative to a comparable apparatus (not shown) in which a comparable at least one cooling fluid channel is isolated from a comparable interface volume. In an embodiment having a first article 102 and a third article 114, the apparatus 100 may also include a reduced thermal gradient 122 between the second article 104 and the third article 114 relative to the comparable apparatus. Without being bound by theory, it is believed that using a cooling fluid from a cooling fluid supply 108 which passes through a heat exchange portion 112 of a cooling fluid channel 110 prior to purging at least one of a first interface volume 106 and a second interface volume 116 may cool the second article 104, may elevate the temperature of at least one of the first interface volume 106 and the second interface volume 116, and may further elevate the temperature of at least one of the first article 102 and the third article 114.

Figure 2:
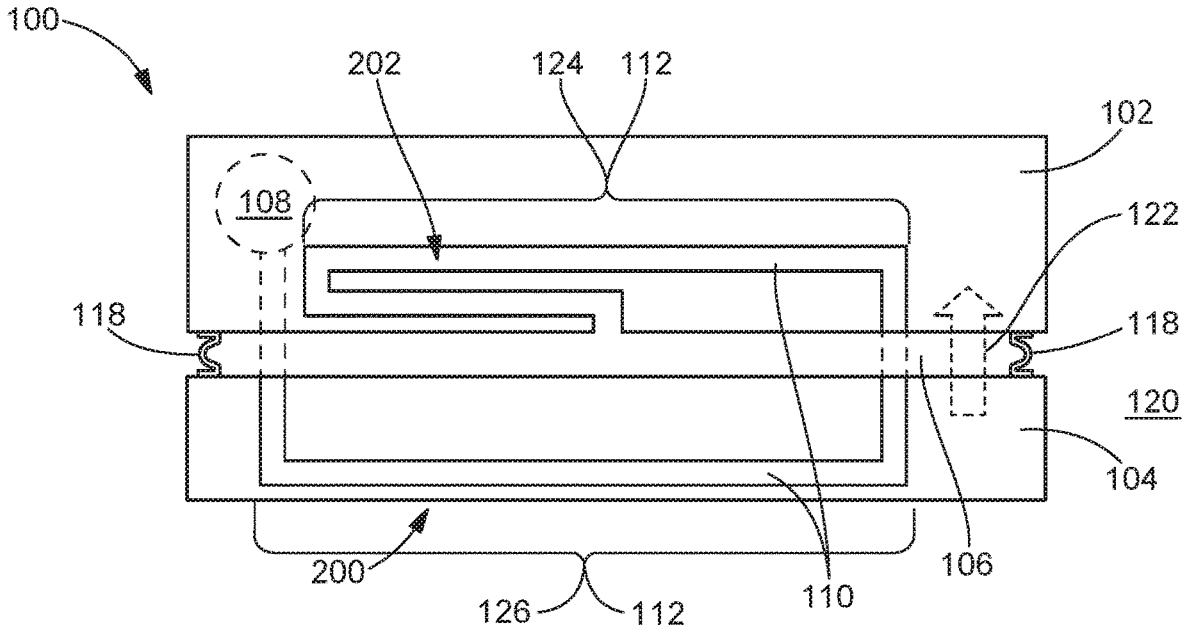
FIG. 2 is a schematic sectioned view of an apparatus including sequential heat exchange portions, according to an embodiment of the present disclosure.
Figure 3:
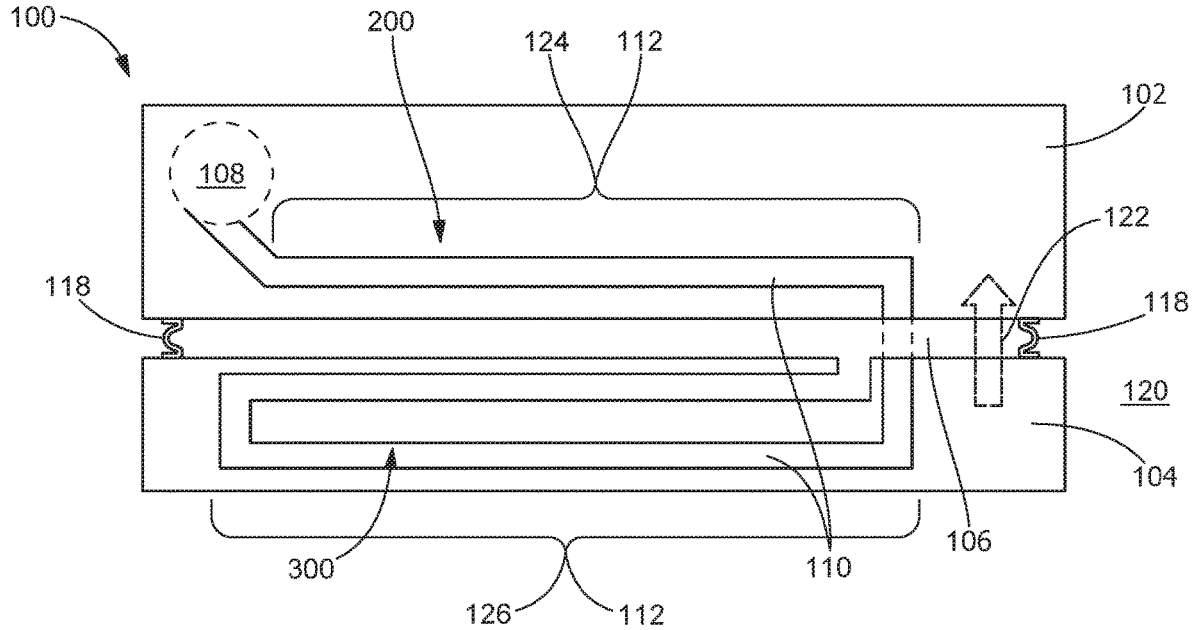
FIG. 3 is a schematic sectioned view of an apparatus including sequential heat exchange portions, according to an embodiment of the present disclosure.

Referring to FIGS. 1-3, in one embodiment, the heat exchange portion 112 includes a first heat exchange portion 124 and a second heat exchange portion 126. The first heat exchange 124 portion and the second heat exchange portion 126 may be in parallel (as shown in FIG. 1) or in sequence (as shown in FIGS. 2-3).

Referring to FIGS. 2 and 3, in one embodiment, the apparatus 100 includes a first heat exchange portion 124 disposed in the first article 102 and a second heat exchange portion 126 disposed in the second article 104. The first heat exchange portion 124 may be downstream of the second heat exchange portion 126 (as shown in FIG. 2), or the first heat exchange portion 124 may be upstream of the second heat exchange portion 126 (as shown in FIG. 3). Passing the cooling gas through the first heat exchange portion 124 prior to passing the cooling gas through the second heat exchange portion 126 may preheat the cooling gas and reduce any negative effects of the second article 104 being exposed to a cooling gas which is too cold, such as, but not limited to, local thermal stresses or delamination. Passing the cooling gas through the second heat exchange portion 126 prior to passing the cooling gas through the first heat exchange portion 124 may preheat the cooling gas and reduce cooling of the first article 104, thereby decreasing the thermal gradient 122.

Referring to FIGS. 1-3, the heat exchange portion 112 may include any suitable conformation, including, but not limited to, a serpentine configuration 128, a 1-pass configuration 200, a 1.5-pass configuration 202, a 2-pass configuration 300, or a combination thereof. As used herein, "serpentine configuration" is not limited to a configuration with sinuous curves, but may also include angled changes of direction. In one embodiment, the configuration of the heat exchange portion 112 is arranged and disposed to thermally regulate the apparatus 100 throughout the full extent of the apparatus 100. Thermal regulation may be a function of the flow of the cooling fluid, cross-sectional flow area within the heat exchange portion 112, surface area within the heat exchange portion 112, cooling fluid temperatures, and the velocity of the flow of the cooling fluid through the cooling fluid channel 110. These parameters may vary along the cooling fluid channel 110 to address variable thermal regulation conditions along the cooling fluid channel 110. In one embodiment, the cooling fluid channel 110 includes turbulators (not shown) such as pin banks, fins, bumps, dimples, and combinations thereof. As used herein, "turbulator" refers to a features which disrupts laminar flow.

The apparatus 100 may be any suitable apparatus, including, but not limited to a turbine component. Suitable turbine components, may include, but are not limited to, nozzles (also known as vanes), shrouds, buckets (also known as blades), turbine cases, and combustor liners.

Figure 4:
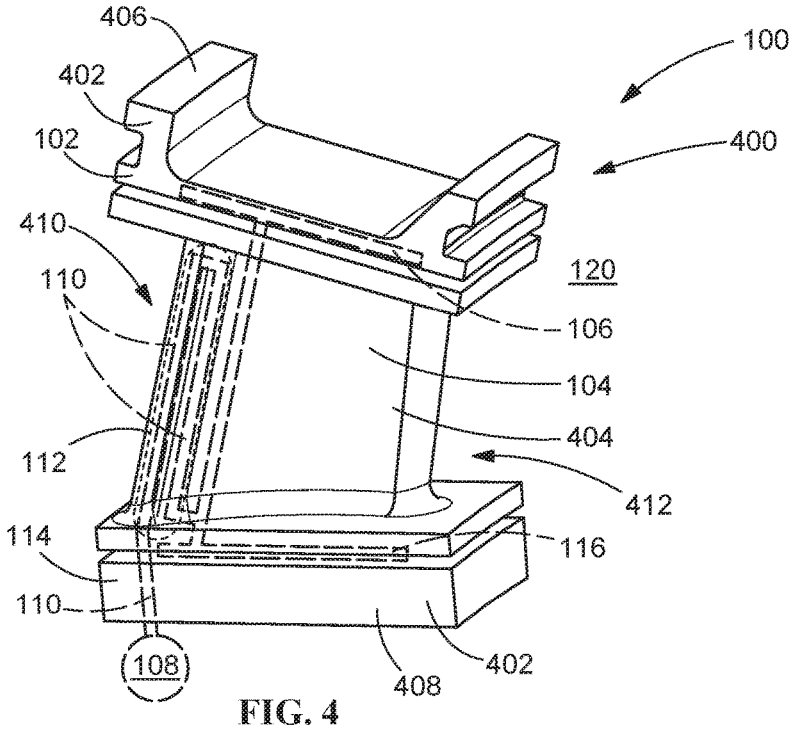
FIG. 4 is a perspective view of a turbine nozzle, according to an embodiment of the present disclosure.

Referring to FIG. 4, in one embodiment the apparatus 100 is a turbine nozzle 400, the first article 102 is an endwall 402, and the second article 104 is a fairing 404. In a further embodiment, the apparatus 100 includes a third article 114, which is also an endwall 402, wherein the first article 102 is an outside wall 406 and the third article is an inside wall 408. The heat exchange portion 112 may be disposed in a leading edge 410 of the fairing (shown), in a trailing edge 412 of the fairing (not shown), or between the leading edge 410 and the trailing edge 412 of the fairing (not shown).

Figure 5:
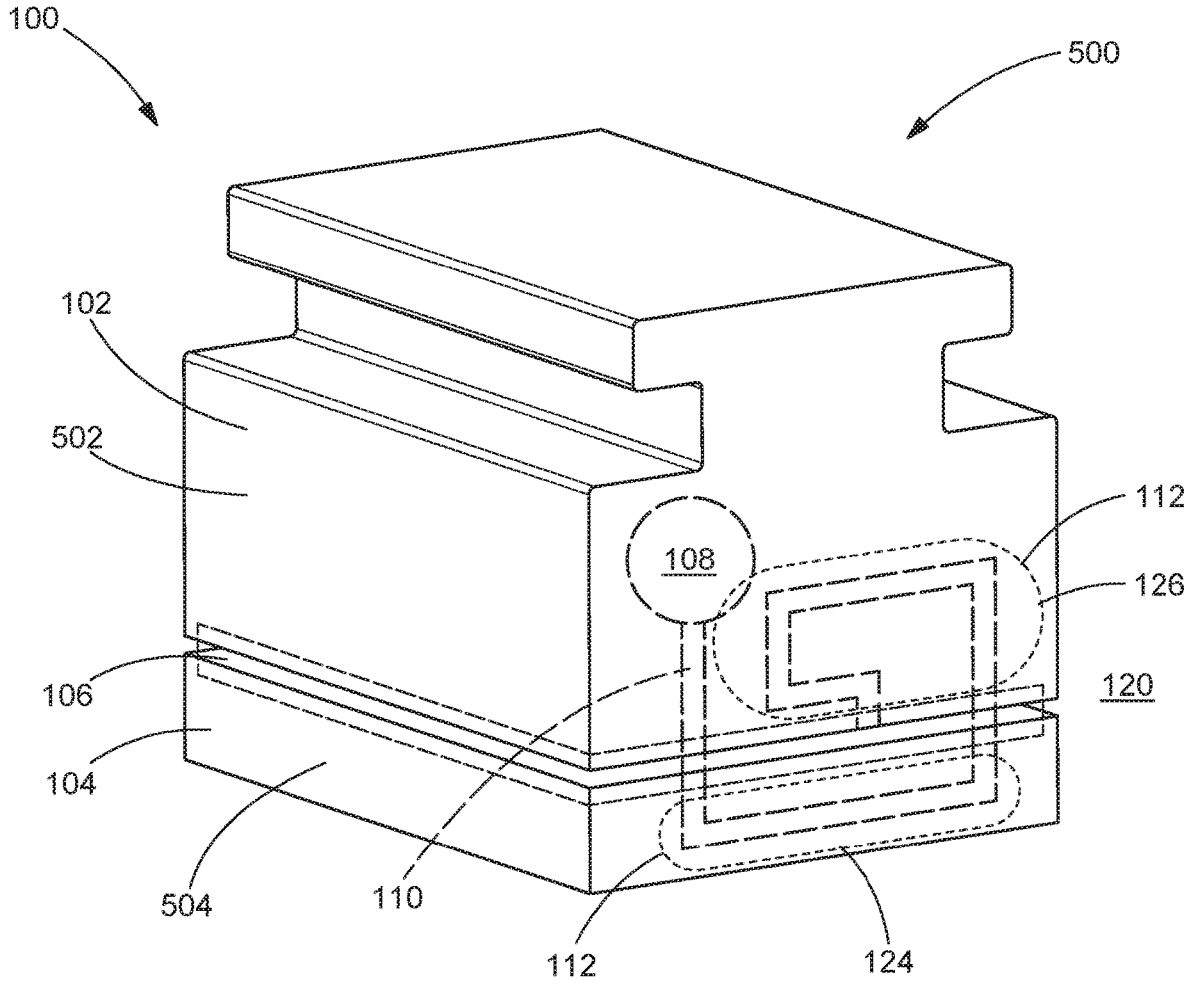
FIG. 5 is a perspective view of turbine shroud, according to an embodiment of the present disclosure.

Referring to FIG. 5, in another embodiment, the apparatus 100 is a turbine shroud 500, the first article is an outer shroud 502, and the second article is an inner shroud 504.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus, comprising:

a first article, the first article including a first material composition;

a second article, the second article including a second material composition;

a first interface volume disposed between and enclosed by the first article and the second article;

a cooling fluid supply; and at least one cooling fluid channel in fluid communication with the cooling fluid supply and the first interface volume, the at least one cooling fluid channel including a heat exchange portion disposed in at least one of the first article and the second article, the heat exchange portion being disposed downstream of the cooling fluid supply and upstream of the first interface volume; wherein the first material composition is metal and the second material composition is a ceramic matrix composite.

2. The apparatus of claim 1, wherein the apparatus is a turbine component.

3. The apparatus of claim 2, wherein the turbine component is a nozzle, the first article is an endwall, and the second article is a fairing.

4. The apparatus of claim 3, wherein the heat exchange portion is disposed in a leading edge of the fairing.

5. The apparatus of claim 3, wherein the heat exchange portion is disposed in a trailing edge of the fairing.

6. The apparatus of claim 2, wherein the turbine component is a shroud, the first article is an outer shroud, and the second article is an inner shroud.

7. The apparatus of claim 1, further including:

a third article, the third article including a third material composition; and a second interface volume disposed between and enclosed by the third article and the second article, wherein the at least one cooling fluid channel is upstream of and in fluid communication with the second interface volume, and the heat exchange portion is upstream of the second interface volume.

8. The apparatus of claim 7, wherein the apparatus is a turbine component, the turbine component is a nozzle, the first article is an outside wall, the second article is a fairing, and the third article is an inside wall.

9. The apparatus of claim 7, wherein the third material composition is the first material composition.

10. The apparatus of claim 1, including a reduced thermal gradient between the metal and the ceramic matrix composite relative to a comparative apparatus which is identical to the apparatus in every way except that the at least one cooling fluid channel of the comparative apparatus is isolated from the interface volume of the comparative apparatus.

11. The apparatus of claim 1, further including a sealing member disposed between the first article and the second article, the sealing member enclosing the first interface volume.

12. The apparatus of claim 11, wherein the sealing member forms a non-hermetic seal between the first article and the second article.

13. The apparatus of claim 1, wherein the first interface volume is arranged and disposed to exhaust a cooling fluid from the cooling fluid supply to an external environment.

14. The apparatus of claim 1, wherein the heat exchange portion includes a first heat exchange portion disposed in the first article and a second heat exchange portion disposed in the second article.

15. The apparatus of claim 14, wherein the first heat exchange portion is upstream of the second heat exchange portion.

16. The apparatus of claim 14, wherein the first heat exchange portion is downstream of the second heat exchange portion.

17. The apparatus of claim 1, wherein the heat exchange portion includes a configuration selected from the group consisting of a 1-pass configuration, a 1.5-pass configuration, a 2-pass configuration, and combinations thereof.

18. A turbine nozzle, comprising:

an outside wall, the outside wall including a metal;

a fairing, the fairing including a ceramic matrix composite;

a first interface volume disposed between and enclosed by the outside wall and the fairing;

an inside wall, the inside wall including a metal;

a second interface volume disposed between and enclosed by the inside wall and the fairing;

a cooling fluid supply; and at least one cooling fluid channel in fluid communication with the cooling fluid supply, the first interface volume, and the second interface volume, the at least one cooling fluid channel including a heat exchange portion disposed downstream of the cooling fluid supply and upstream of the first interface volume and the second interface volume.

19. A turbine shroud, comprising:

an outer shroud, the outer shroud including a metal;

an inner shroud, the inner shroud including a ceramic matrix composite;

a first interface volume disposed between and enclosed by the outer shroud and the inner shroud;

a cooling fluid supply; and at least one cooling fluid channel in fluid communication with the cooling fluid supply and the first interface volume, the at least one cooling fluid channel including a heat exchange portion disposed downstream of the cooling fluid supply and upstream of the first interface volume.

* * * * *